United States Patent [19]

Zwick et al.

[11] 4,374,637

[45] Feb. 22, 1983

[54] BURNER CONSTRUCTION

[75] Inventors: Eugene B. Zwick, Huntington Beach; Dung D. Nguyen, Fullterton; William D. Brigham, Westminister; Kenneth Hoffman, Fountain Valley, all of Calif.

[73] Assignee: Zwick Energy Research Organization, Inc., Santa Ana, Calif.

[21] Appl. No.: 956,375

[22] Filed: Oct. 31, 1978

[51] Int. Cl.[3] ..... F23M 9/00

[52] U.S. Cl. ..... 431/183; 431/285; 431/352

[58] Field of Search ..... 431/9, 116, 171, 174, 431/175, 177, 183, 285, 284, 351, 352

[56] References Cited

U.S. PATENT DOCUMENTS

| | | | |
|---|---|---|---|
| 3,032,097 | 5/1962 | Marshall | 431/9 |
| 3,349,826 | 10/1967 | Poole et al. | 431/183 |
| 3,834,858 | 9/1974 | Krippene et al. | 431/175 |
| 3,852,020 | 12/1974 | Peczeli et al. | 431/9 |
| 4,021,186 | 5/1977 | Tenner | 431/352 |
| 4,035,137 | 7/1977 | Arand | 431/285 |
| 4,118,171 | 10/1978 | Flanagan et al. | 431/352 |

*Primary Examiner*—Samuel Scott
*Assistant Examiner*—Lee E. Barrett
*Attorney, Agent, or Firm*—Smyth, Pavitt, Siegemund & Martella

[57] ABSTRACT

A burner having a burner body in which combustion air is injected in an air flow pattern which establishes a relatively stagnant air region positioned within the flow of combustion air. A pilot flame injector is positioned to generate a pilot flame extending into the stagnant air region. The pilot flame can, thus, be maintained during the operation of the burner because the stable air conditions within the stagnant air region minimize disruption of the pilot flame by the flow of combustion air.

A method for maintaining a uniform pilot flame within a burner operating over a range of combustion air flow rates by introducing combustion air into the burner and providing the combustion air with a flow configuration that establishes a stagnant air zone within the burner that is relatively independent of the flow rate of the combustion air. The pilot flame is then positioned within the stagnant air zone.

An injector for feeding finely divided fuel to a burner. The injector includes means to provide an annular passage through which air may flow at high velocity for discharge into a burner. Means are provided to feed fuel into the annular passage such that the fuel may be broken up into minute droplets by the air flow through the passage. Additionally the means to feed fuel are positioned to minimize contact between the fuel and the passage surfaces. Thus, the fuel may be broken up into minute droplets within the air flow stream with the finely divided fuel being discharged into a burner.

16 Claims, 7 Drawing Figures

72

94
114
104
48
130
128
122
126
124
120
116
118
28
54
68
110
46
144
138
98
108
152
156
136
134
140
148
158
66
132
150
142
154
146
112
110
114
120
106
48
122
68
92
118
116

BURNER CONSTRUCTION

BACKGROUND OF THE INVENTION

Gaseous nitrogen is used in many industrial applications. For example, gaseous nitrogen may be used to purge tanks of air which are to be filled with chemicals that are reactive with air. Also, gaseous nitrogen is used in various oilfield operations such as in fracturing a formation or in completing a well by freeing the drill pipe of drilling mud.

Nitrogen is shipped and stored as a very cold liquid having a boiling point of −195.8° C. Before nitrogen can be used in the form of a gas, it is, therefore, necessary that the liquid nitrogen be gasified. This is commonly done by using a burner that generates hot combustion gases which contact heat exchanger tubes to impart heat to nitrogen within the tubes to convert the liquid nitrogen to a gas. In gasifying liquid nitrogen for a particular use, only enough nitrogen is gasified as is required for the particular use. Also, in a use application for gaseous nitrogen, the particular application may be interrupted so that the need for gaseous nitrogen is momentarily halted, then resumed at a later time, etc. In any application where the need for gaseous nitrogen is temporarily halted, the burner which is used in gasifying liquid nitrogen will generally be shut down and will then be restarted when there is a further need for gaseous nitrogen. This has created problems since delays may occur because of difficulties in restarting the burner, particularly, for example, in an arctic environment where oil field operations may be carried out.

When there are delays in restarting a burner used for the gasification of nitrogen, this may be quite costly since it may delay the drilling of an oil well or the loading of a large ship, etc. At the same time, it is costly to operate a burner merely to keep the burner in readiness even though the burner is not needed at that particular time for the gasification of nitrogen.

Accordingly, it would be desirable if a burner could be provided which could be easily shut down and restarted without any lengthy delays. Such a burner could be used intermittently and could still be shut down when not in use so as to conserve on the use of fuel.

SUMMARY OF THE INVENTION

In accord with the present invention we have provided a burner which may be used intermittently without having to be restarted. The present burner is admirably suited for oil field operations where it may be necessary to gasify a quantity of liquid nitrogen for a given operation and to then shut down the burner until a later time when more gaseous nitrogen is required, etc.

According to the present invention, a burner is provided in which the pilot flame may be maintained in a relatively stable condition during the entire mode of operation of the burner. To accomplish this result, a burner body which defines a combustion zone may include an inlet opening with a pilot flame injector positioned centrally with respect to the inlet opening. Means may be provided to supply finely divided fuel through the pilot flame injector and means may be provided to introduce combustion air about the injector.

In introducing combustion air about the pilot flame injector, the combustion air may be injected in a generally tangential direction with respect to the pilot flame injector to produce an air flow which is directed forwardly in an axial direction away from the pilot flame injector and also tangentially with respect to the burner body. The combustion air flow may, thereby, establish a reverse secondary air flow that provides a stagnant air region which encircles the pilot flame injector.

The combustion air as it flows past the stagnant air region pulls air from the stagnant air region at the interface between the secondary flow and the combustion air flow. This may cause a reduction in pressure in the stagnant air region. This reduction in pressure produces a driving force which assists in providing the secondary air flow in which a portion of the combustion air and combustion gases flows rearwardly to return air to the stagnant air region. The extent of the return air flow to the stagnant air region may be proportional to the flow of air from the stagnant air region of the interface between the secondary air flow and the combustion air flow. Thus, the stagnant air region is maintained relatively constant irrespective of the flow rate of the combustion air. As a result, a pilot flame from the pilot flame injector may be maintained relative constant within the stagnant air region irrespective of the flow rate of combustion air in the burner. The pilot flame may, therefore, be left on during the entire combustion operation so that the burner may be maintained in a state of readiness by having the pilot flame lit.

A plurality of combustion flame injectors may be positioned about the pilot flame injector. The combustion flame injectors are positioned to discharge finely divided fuel into the combustion air stream. Additionally, the combustion flame injectors may be positioned so as to make minimal or no contact of injected fuel with the inlet opening and to provide a minimal discharge of fuel into the stagnant air region.

A soot protector may be positioned about the pilot flame injector. The soot protector may extend toward the combustion flame injectors and be heatable to a sufficient extent by the surrounding environment to prevent the formation of soot thereon through contact of unburned fuel with the soot protector. The inlet opening to the burner may include a curved surface which opens outwardly in a downstream direction. The curved surface may be positioned axially with respect to the burner body. Thus, combustion air entering the burner moves forwardly by moving along the curved surface.

The burner body may include a mixing chamber which communicates with the burner body through the inlet opening. The mixing chamber may provide a plurality of vanes which are positioned about the outer diameter of the mixing chamber. In usage, the vanes may receive air and may direct the air in a swirling movement within the mixing chamber and burner body. The pilot flame injector and the combustion flame injectors of the burner may extend through the back surface of the mixing chamber.

The burner may also include means to intermix cool air with combustion gases which are formed in the burner. The means to intermix cool air may be positioned downstream a sufficient distance from the inlet opening to the burner so as to permit the essential completion of combustion within the burner before intermixing of the cool air with the combustion gases.

In addition to providing a burner, the present invention provides a method for maintaining a relatively uniform pilot flame within a burner which operates over a range of combustion air flow rates. In accord with the method, combustion air is introduced into the burner and the combustion air is provided with a flow configuration which establishes a stagnant air zone within the burner which is relatively independent of the flow rate of combustion air. The pilot flame for the burner is positioned within the stagnant air zone. In this manner, the pilot flame is relatively unaffected by the flow rate of the combustion air within the burner.

In addition to the foregoing, the present invention provides an injector for feeding finely divided fuel to a burner. The injector comprises means which provide an annular passage through which air may flow at high velocities for discharge into a burner. Means are provided to feed fuel into the passage such that the fuel may be broken up into minute droplets by the air flow through the passage. The means to feed fuel into the annular passage is positioned so as to minimize contact of the fuel with the passage surfaces. As a result, fuel may be broken up into minute droplets within the air flow stream and may then be discharged in finely divided form into a burner.

THE DRAWINGS

To illustrate a specific embodiment of the invention, reference is made to the accompanying drawings in which.

Figure 3:
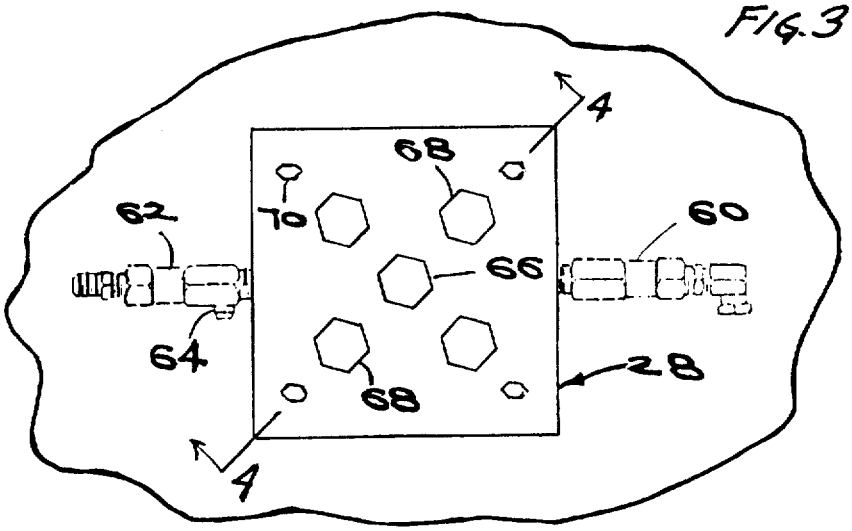
FIG. 3 is a view taken along the line 3—3 of FIG. 1 to illustrate the outer configuration of a fuel-air manifold through which finely divided fuel may be supplied to the mixing chamber for the burner.
Figure 4:
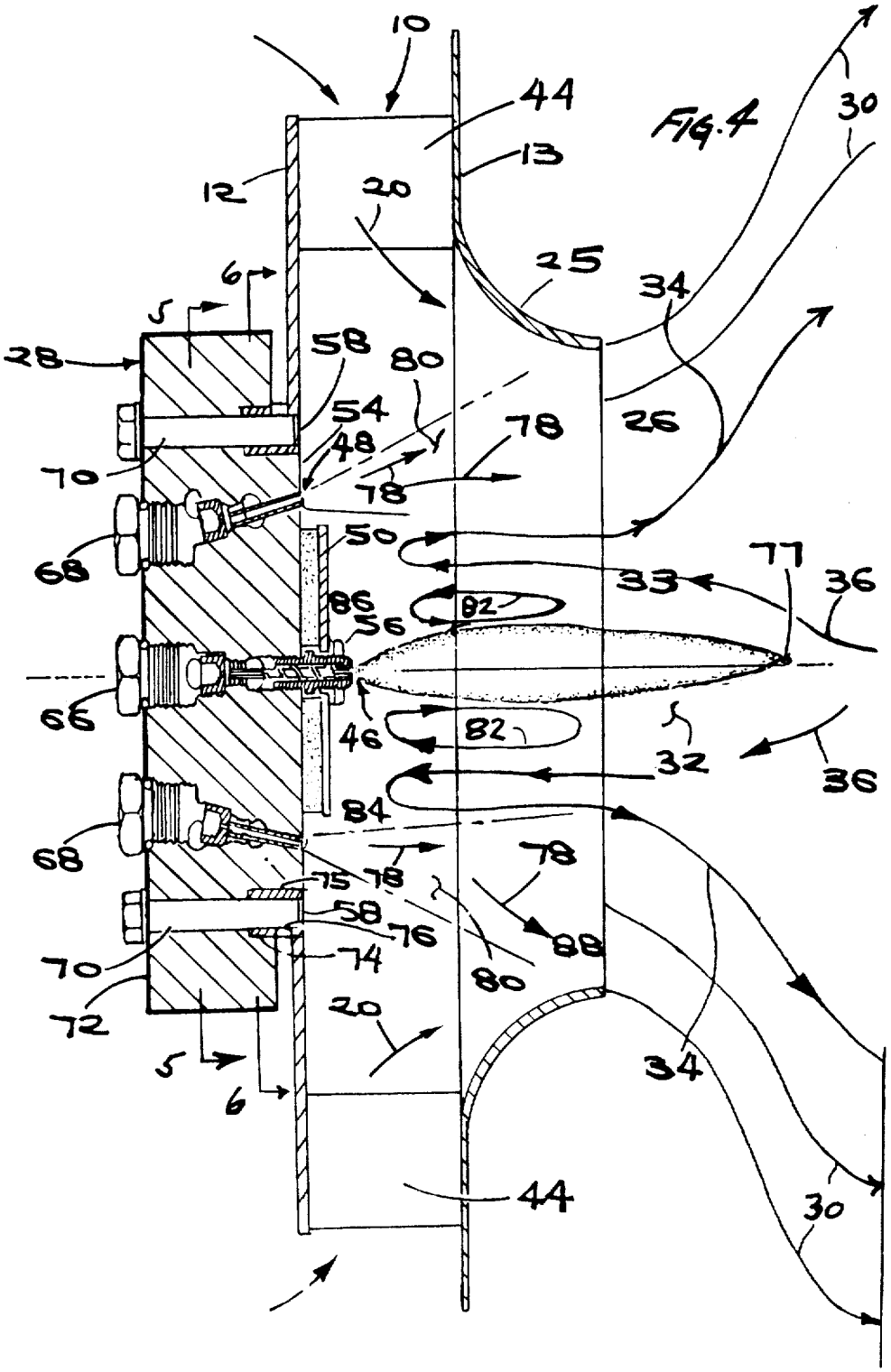
FIG. 4 is a sectional view taken along the line 4—4 of FIG. 3 to illustrate the configuration of the fuel-air manifold and the mixing chamber.
Figure 6:
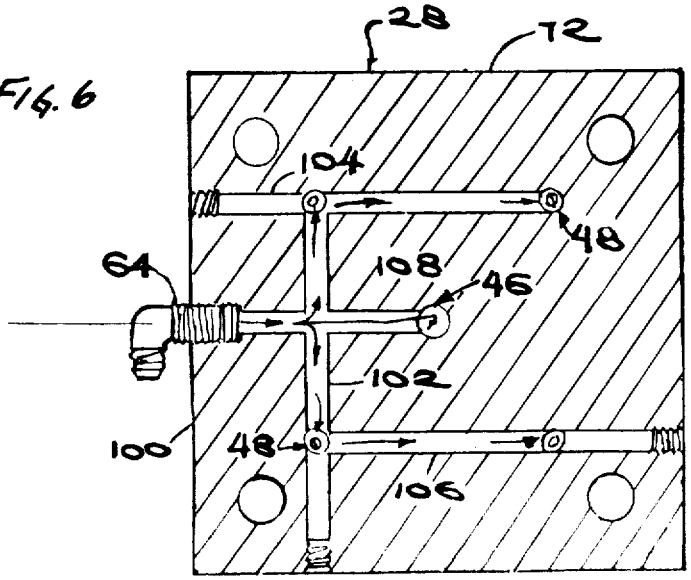
Figure 7:
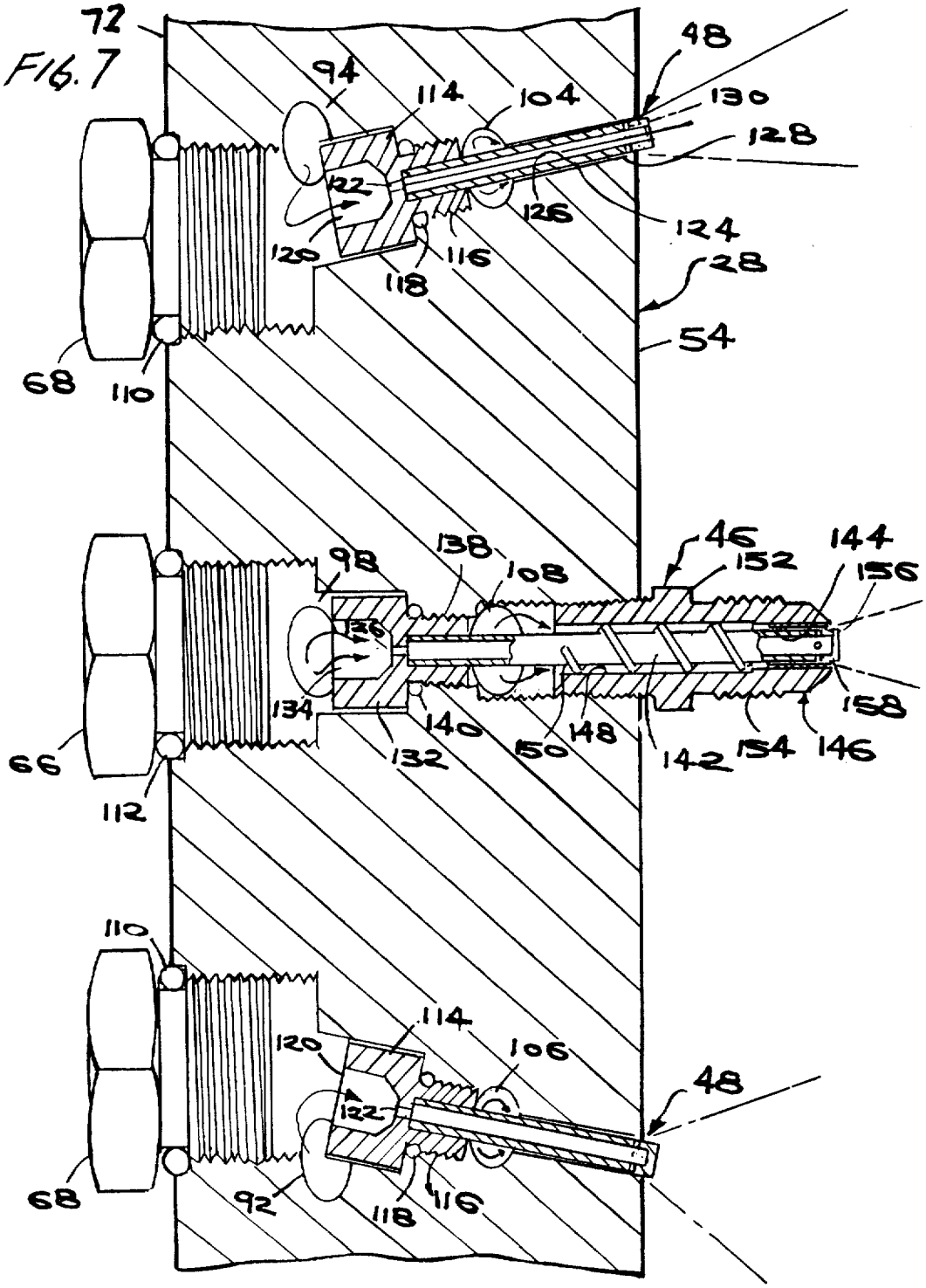

FIG. 6 is a sectional view taken along the line 6—6 of FIG. 4 to illustrate the air flow passages within the fuel-air manifold utilized to supply air to the combustion flame injectors and to the pilot flame injector, and FIG. 7 is an enlarged sectional view taken along the same sectional line as that of FIG. 4 (see the section line 4—4 in FIG. 3) to illustrate in greater detail the configuration of the combustion flame injectors and the pilot flame injector which are utilized in supplying finely divided fuel to the burner.

DETAILED DESCRIPTION

Figure 1:
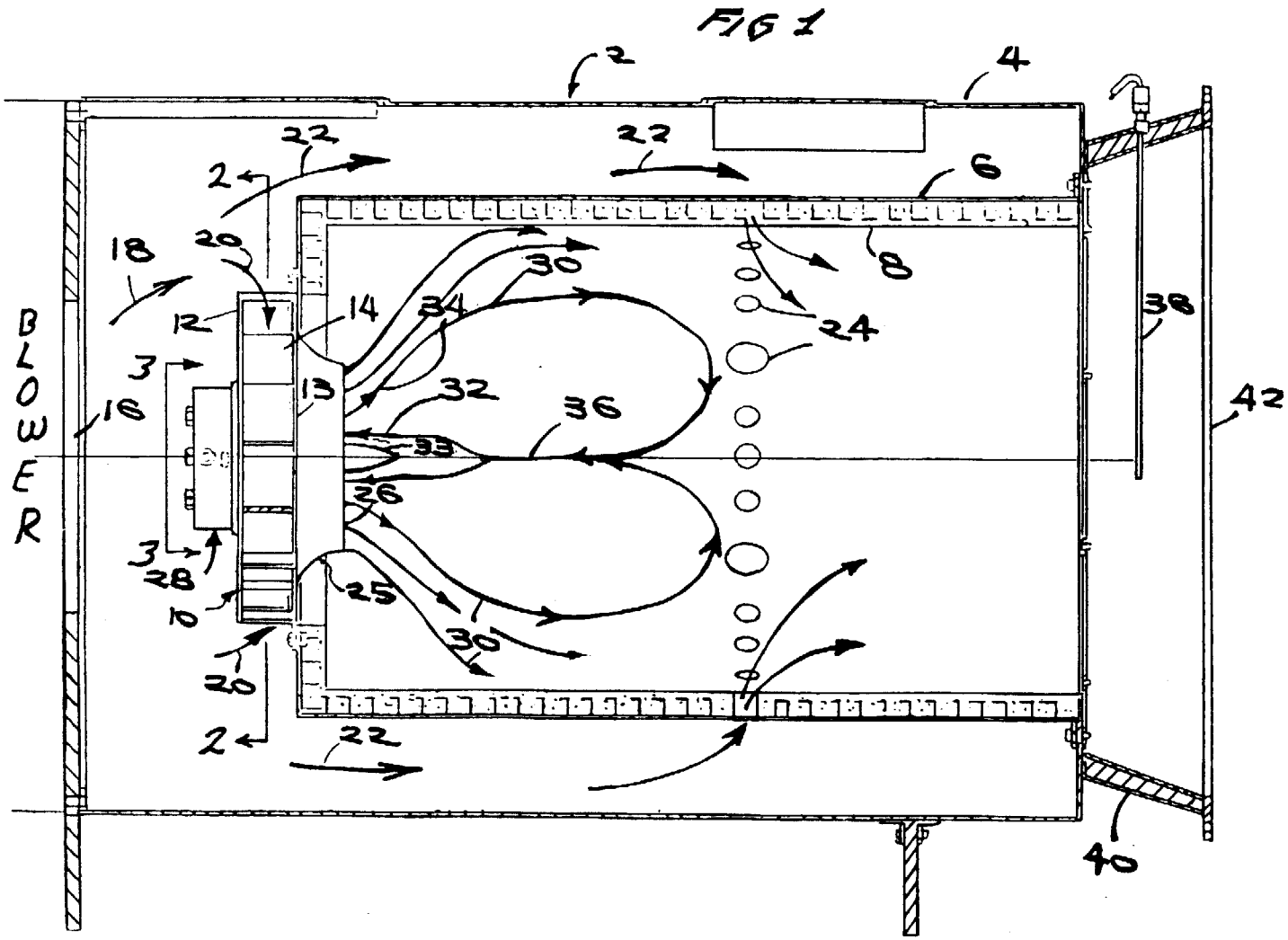
FIG. 1 is a longitudinal cross sectional view of the burner of the invention which provides a pilot flame that remains relatively constant over the entire range of operations of the burner.

FIG. 1 illustrates a burner 2 of the invention in which a shell 4 is positioned about a burner body 6 having insulation 8 affixed to its interior surface. A mixing chamber 10 is positioned at one end of the burner body 6 with the mixing chamber positioned coaxially with respect to the burner body. The mixing chamber 10 may include a back plate 12 and a front plate 13 which is spaced apart from the back plate. A plurality of air openings 14 may be formed about the exterior of the mixing chamber 10 with the air openings receiving air from a blower opening 16 in the shell 4.

A blower (not shown) may be mounted outside of the shell 4 to supply air through the blower opening 16. The incoming air represented by arrows designated 18 may be split into combustion air indicated by the arrows designated 20 and dilution air indicated by the arrows designated 22. The combustion air 20 may pass through the air openings 14 into mixing chamber 10 while the dilution air 22 may pass along the interior of the shell 4 to enter the burner body 6 through the dilution apertures 24 which are positioned downstream from the mixing chamber 10.

In operation, dilution air 22 may be used to cool combustion gases formed within the burner body 6 to a desired temperature for performing useful work such as, for example, in gasifying liquid nitrogen within a heat exchanger. To facilitate the mixing of dilution air 22 with combustion gases, the dilution apertures 24 may have varying sizes, as indicated. The larger sized apertures 24 may admit a larger stream of dilution air 22 which forces its way more deeply into the interior of the burner body 6 while smaller sized dilution apertures 24 may admit dilution air which does not penetrate deeply into the burner body and mixes more readily with combustion gases near the surface of the burner body.

As will be described, the combustion air 20 is provided with a swirling motion as it enters the air openings 14. Due to this swirling motion, the combustion air 20 moves outwardly, i.e., in a radial direction relative to the axis of the burner body 6. The combustion air 20, in moving both axially and radially with respect to burner body 6 may flow forward through a front extension 25 of the mixing chamber 10 to exit through an inlet opening 26. A fuel-air manifold 28 joined to the back plate 12 may supply finely atomized fuel to the mixing chamber 10, as will be described, such that the finely divided fuel is carried into the interior of the burner body 6 by the combustion air 20. Due to the swirling motion of the combustion air 20 as it passes through the inlet opening 26, the combustion air may fan outwardly in a radial direction relative to the burner body 6 as indicated by the arrows designated 30.

The swirling motion of the combustion air 20 in its passage through inlet opening 26, which tends to force the air radially outward in the direction of arrows 30, may create a recirculating secondary flow 36. This may in turn lead to the formation of a stagnant air region 32 adjacent to the inlet opening. Additional considerations which may lead to the formation of the stagnant air region 32 will be presented in connection with the description of FIG. 4. The air movement within the stagnant air region 32 may be relatively calm. A pilot flame 33 which extends into the stagnant region 32 may, therefore, be maintained relatively constant in its burning because of the relatively calm air conditions. As combustion air 20 passes through the inlet opening 26, there is an interface region designated 34 formed between the rapidly moving combustion air and the air flow within the recirculating secondary flow 36. At the interface region 34, turbulent momentum transfer from the rapidly moving combustion air 20 to the secondary flow 36 causes the secondary flow to swirl and to travel with the combustion air flow 20 as it moves in the direction of arrows 30. This motion of the secondary flow 36 in the direction 30 together with its swirling motion may lead to a reduction in pressure within the stagnant air region 32.

The reduction in pressure within the stagnant air region 32 may create a driving force which establishes a return flow of the secondary air flow 36 along the axis of the burner body in which a portion of air and exhaust gases is recycled to the stagnant air region. As the flow rate of the combustion air 20 increases, a high rate of momentum transfer may take place along the interface 34 leading to lower pressures within the stagnant air region 32 which are sufficient to cause recirculation of the higher velocity secondary flow 36 back towards the stagnant air region. An equilibrium may, thus, be established within the stagnant air region 32 which is relatively independent of the flow rate of combustion air 20. This equilibrium condition within the stagnant air region 32 may provide a stable environment for the pilot flame 33 over a wide range of operating conditions.

In the operation of the burner of the invention, the pilot flame 33 may, therefore, be left on at all times. This makes the burner 2 more useful by reducing the need for restarting the burner in the field when the burner is being used intermittently. For example, the burner 2 may be used to generate hot combustion gases in vaporizing liquid nitrogen for use in an oil field operation. After vaporizing a given quantity of nitrogen for a particular operation, the burner may be maintained ready for use by leaving the pilot flame 33 lit. This is advantageous in the use of the burner 2 since the cost of waiting to perform a particular oilfield operation may be quite expensive and may far outweigh the minimal cost of maintaining the pilot flame 33 lit to avoid the possible delays during start up of the burner from a cold condition.

As indicated in FIG. 1, a thermocouple 38 may project inwardly from a skirt 40 affixed to the burner body 6. The thermocouple 38 may be used for metering the temperature of exhaust gases from the burner 2. A flange 42 may be secured to the skirt 40 so that the burner 2 may be readily coupled to a heat exchanger (not shown).

Figure 2:
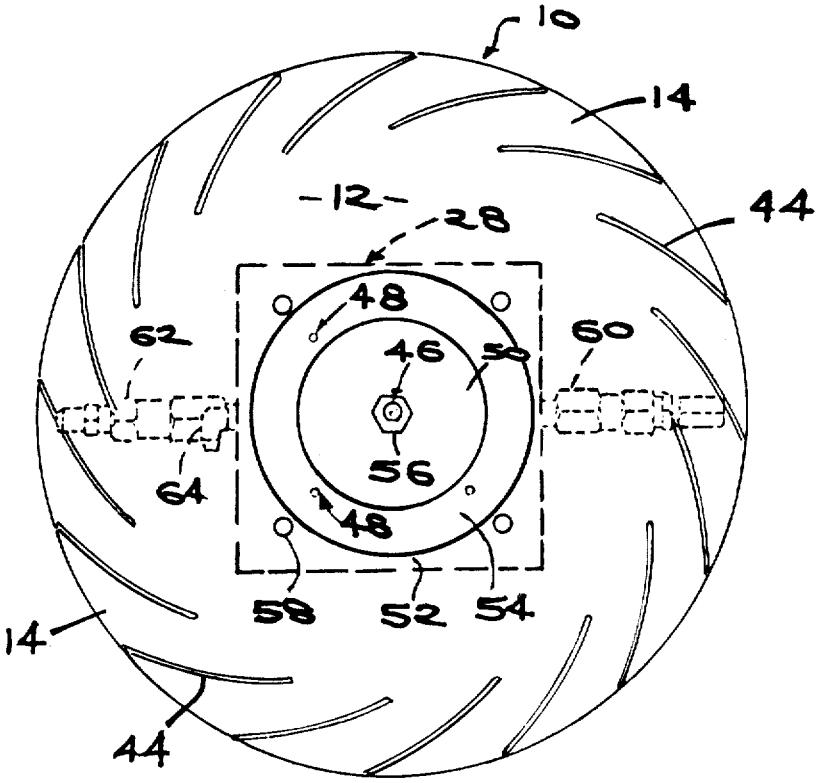
FIG. 2 is a sectional view taken along the line 2—2 of FIG. 1 to illustrate the internal configuration of the mixing chamber which supplies fuel and combustion air to the burner body.

FIG. 2 is a sectional view taken along line 2—2 of FIG. 1 to illustrate the interior of mixing chamber 10 in greater detail. As indicated, the air openings 14 are formed by a plurality of vanes 44. The vanes 44 may have a slight curvature, as indicated, with the vanes being positioned to impart a swirling movement to air which enters the mixing chamber 10 through air openings 14. As described previously in regard to FIG. 1, the swirling movement which is imparted to air entering through air openings 14 creates flow forces which cause the air flow to move radially outwardly, after leaving the mixing chamber 10.

The fuel-air manifold 28, shown in phantom line drawing in FIG. 2, provides atomized fuel through a pilot flame injector 46. The pilot flame injector 46 supplies a mixture of fuel and air to the relatively stable pilot flame 33 with the pilot flame injector being positioned centrally with respect to inlet opening 26 such that the pilot flame is positioned on the axis of the burner body 6 (see FIG. 1).

Positioned about the pilot flame injector 46 are a plurality of combustion flame injectors 48. The combustion flame injectors 48 may be symmetrically spaced with respect to the pilot flame injector 46. With four combustion flame injectors 48 being indicated, the injectors may be positioned at the four corners of a square relative to the pilot flame injector 46. If desired, the number of combustion flame injectors 48 may be varied, for example, depending upon the size of the burner body 6 as described in FIG. 1. If the diameter of the burner body 6 is increased, the number of combustion flame injectors 48 may be increased to supply a larger quantity of finely divided fuel for combustion. For example, the number of combustion flame injectors 48 could be increased to eight with the combustion flame injectors being positioned uniformly about a pilot flame injector 46 as indicated in FIG. 2.

To prevent the formation of soot on the back plate 12, a soot protector 50 may be supported by the pilot flame injector 46 with the flame deflector positioned in spaced relation with respect to the back plate 12. In operation, the soot protector 50 may be heated by the environment of the mixing chamber 10 to a temperature at which soot will not form on the soot protector. When unburned fuel supplied through combustion flame injectors 48 or through pilot flame injector 46 contacts the soot protector 50 by reason of the air currents within the mixing chamber 10, the unburned fuel will, thus, not form soot on the soot protector.

In supporting the manifold 28 with respect to mixing chamber 10, an opening 52 may be formed in the back plate 12. A raised surface 54 extending inwardly from the manifold 28 may project through the opening 52. As indicated, the configuration of the raised surface 54 may match the shape of the opening 52 such that the raised surface is snugly retained within the opening. The soot protector 50 may cover a portion of the raised surface 54 with a nut 56 engaging the exterior of the pilot flame injector 46 to support the soot protector. A plurality of locator holes 58 in the back plate 12 may serve to position the fuel-air manifold 28 relative to the mixing chamber 10. Bolts which attach the manifold 28 to the back plate 12, as will be described, may extend into the locator holes 58 to insure that the position of the manifold is fixed with respect to the mixing chamber.

A pilot fuel line indicated in phantom line drawing as 60 may lead to the fuel-air manifold 28 to supply fuel to the pilot flame injector 46. As described, the pilot flame injector 46 may be operated continuously in supplying atomized fuel to the relatively stable pilot flame 33 (see FIG. 1). Thus, the pilot fuel line 60 may be kept separate from a combustion fuel line 62 through which atomized fuel may be supplied to the combustion flame injectors 48. The combustion flame injectors 48 may be turned off when the burner 2 is not in operation or the flow rate of atomized fuel through the combustion flame injectors may be increased or decreased, as desired, to increase or decrease the level of combustion within the burner body 6 (see FIG. 1). An air line indicated in phantom line drawing as 64 may supply air continuously to the pilot flame injector 46 and also to the combustion flame injectors 48. Unlike the fuel lines 60 and 62, the air line 64 may function in a relatively continuous manner in supplying air to both the pilot flame injector 46 and to the combustion flame injectors 48. The functioning of the fuel lines 60 and 62 and the air line 64 will be described subsequently along with a detailed description of the functioning of the fuel-air manifold 28.

Referring to FIG. 3, which is an end view taken along the line 3—3 of FIG. 1, the fuel-air manifold 28 may include a pilot hole plug 66 and a plurality of combustion hole plugs 68. In the formation of passages within the fuel-air manifold 28, as will be described, holes may be drilled in the exterior surface of the fuel manifold. These holes may then be plugged to provide sealed passages within the manifold 28 by the use of plugs 66 and 68, as indicated, which threadedly engage the passages as they extend outwardly through the surface of the manifold. Also, by removing the plugs 66 and 68, the passages within the manifold 28 may be conveniently reached for periodic cleaning. As described, the rotational position of the manifold 28 with respect to the mixing chamber 10 may be fixed by means of locator holes 58 formed in the back plate 12 of the mixing chamber. Mounting bolts passing through the manifold 28 may extend into the locator holes 58 to fix the position of the manifold with respect to the mixing chamber 10.

FIG. 4 is an enlarged sectional view taken along the line 4—4 of FIG. 3 to illustrate the internal configuration of the manifold 28 and the positioning of the manifold with respect to the mixing chamber 10. The manifold 28 includes a block 72 through which the mounting bolts 70 extend in fixing the position of the manifold with respect to the mixing chamber 10. The bolts 70 may be retained within the block 72 by a flat ring 75 with threaded holes 76 therein which is welded to the back plate 12. The bolts 70 are then threaded into the holes 76 in the ring 75. Additionally, bushings 74 may be welded to the ring 76 to aid in locating the manifold 28 with respect to the back plate 12 during assembly.

As indicated, the combustion flame injectors 48 discharge finely divided fuel indicated by the arrows 78 in the form of a spray cone 80. The combustion flame injectors 48 are desirably positioned at an angle relative to the pilot flame injector 46, as indicated in FIG. 4, so that the spray cones 80 do not extend into the stagnant air region 32 to disrupt the stagnant air region or the pilot flame 33 positioned therein. Additionally, the combustion flame injectors 48 are positioned to discharge finely divided fuel 78 into the combustion air 20 as it passes through the mixing chamber 10 in a swirling configuration such that the discharged fuel does not impinge on the inlet opening 26 or on the wall of the burner body 6.

The discharge of fuel and air from the pilot flame injector 46 into the pilot flame 33 may be a major factor in the formation of the stagnant region 32 within which the pilot flame 33 burns. The discharge from injector 46 flows along the axis of the mixing chamber 10 away from the back plate 12 in flow opposition to the recirculating secondary flow 36 which flows along the axis of the burner body 6 towards the back plate 12 of the mixing chamber 10. The opposition of these two flows leads to the formation of a stagnation point 77 in the flow field with a surrounding stagnation region 32. The recirculating secondary flow 36 may flow around the stagnation region 32 and the pilot flame 33 towards the back plate 12 and then turn spirally outward to become entrained by the incoming combustion air 20 as described previously.

The discharge of fuel and air from the pilot flame injector 46 into the pilot flame 33 may also set up an additional secondary swirl pattern as indicated by the arrows designated 82. The air movement indicated by the recirculating secondary flow 36 and the swirl patterns 82 may carry hot gases containing unburned fuel discharged by the pilot flame injector 46 or by the combustion flame injectors 48 into contact with the flame deflector 50. As described, the soot protector 50 may be maintained at an elevated temperature by the environment of the mixing chamber 10 so that soot does not form on the soot protector. To insure that the flame deflector 50 is maintained at an elevated temperature, insulation 84 may be placed between the soot protector 50 and the metal of the block 72. Additionally, insulation 86 may be placed between the soot protector 50 and the nut 56. Desirably, the soot protector 50 has a central aperture which is larger than the exterior dimension of the pilot flame injector 46. Thus, the soot protector 50 may be isolated from the surrounding metal surfaces so that heat cannot be carried away from the soot protector by the surrounding metal.

As indicated, the front plate 13 of mixing chamber 10 may lead to a front extension 25 which has a gradually curved interior surface 88. The curvature of interior surface 88 may convey the combustion air 20 in a smooth and continuous fashion from the mixing chamber 10 through the inlet opening 26. As described, the swirling movement of the combustion air 20 within the mixing chamber 10 from contact with the vanes 44 produces a swirling motion within the combustion air which tends to cause the air to move radially outwardly. This movement of combustion air 20 causes the air to follow closely along the interior surface 88. The flow of the combustion air 20 does not disturb the relative stability of the air within the stagnant air region 32 even though the flow rate of the combustion air may vary widely during the overall combustion operation.

Figure 5:
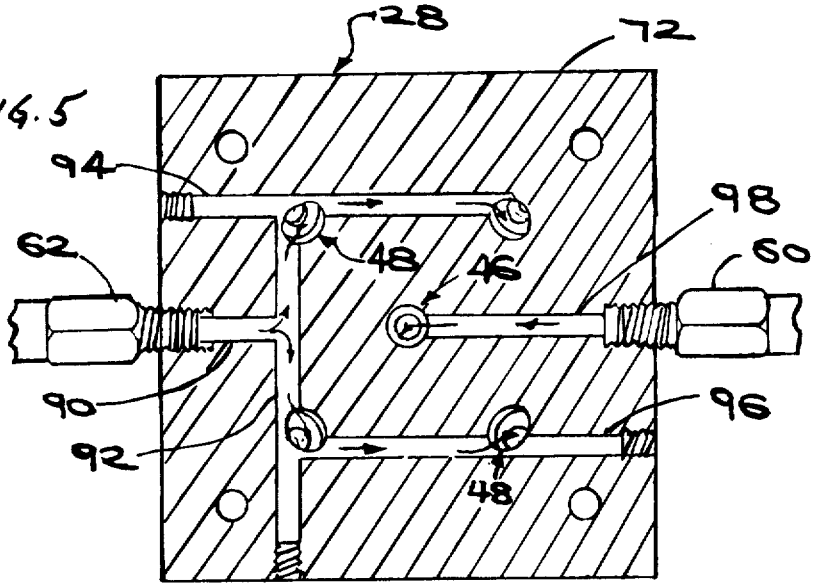
FIG. 5 is a sectional view taken along the line 5—5 of FIG. 4 to illustrate the fuel passages within the fuel-air manifold for supplying fuel to the combustion injectors and to the pilot flame injector.

FIG. 5 is a sectional view taken along line 5—5 of FIG. 4 which demonstrates the configuration of fuel passages within the block 72. As indicated, the combustion fuel line 62 may threadably engage a fuel line 90 within the block 72 which leads to a cross line 92. The cross line 92 may directly feed fuel to two combustion flame injectors 48 while also feeding fuel to additional fuel lines 94 and 96. The fuel lines 94 and 96 lead to the other combustion flame injectors 48 with the result that all of the combustion flame injectors may be supplied with fuel from the single fuel line 62.

The pilot fuel line 60, which is separate from the combustion fuel line 62, is threadedly engaged with the fuel line 98 that leads directly to the pilot flame injector 46. The pilot flame injector 46 may, thus, be continuously supplied with constant flow of finely divided fuel while the fuel supply to the combustion flame injectors 48 may be varied dependent upon the combustion conditions prevailing within the burner.

FIG. 6 is a sectional view taken along line 6—6 of FIG. 4 to illustrate the configuration of the air passages within the block 72. In supplying air to the pilot flame injector 46 and to the combustion flame injectors 48, the air line 64 may threadedly engage an air passage 100 which leads to a cross passage 102. The cross passage 102 may feed air directly to two of the combustion flame injectors 48 and may also lead to air passages 104 and 106. The air passages 104 and 106 may supply air to the remaining combustion flame injectors 48 while an air passage 108 continuously supplies air to the pilot flame injector 46. The injectors which may be used in the burner of the present invention, as will be described, are adequate to break up the fuel into finely divided particles under varying fuel rates.

FIG. 7 is a cross sectional view taken along the same section as FIG. 4 which illustates a greatly enlarged view of the internal configuration of the pilot flame injector 46 and the combustion flame injectors 48. As discussed in regard to FIG. 3, the exterior hole leading to the pilot flame injector 46 may be sealed by a plug 66 while the exterior holes leading to the combustion flame injectors 48 may be sealed by plugs 68. The plugs 68 may bear against an O-ring 110 while the plug 66 may bear against an O-ring 112 in forming tight seals. The combustion flame injectors 48 may each include a seat member 114 which is in threaded engagement with threads 116 and bears against an O-ring 118. An opening 120 may be defined by the seat member 114 with the opening receiving fuel from line 94 or 92, as the case may be in FIG. 7. The fuel received within opening 120 may then flow through a constriction 122 and into a tube 124 having an internal passage 126. Positioned about the tube 124 is a passage 128 formed within the block 72. As illustrated, the passage 128 is only slightly larger than the external dimension of the tube 124 to create a narrow annulus between the internal surface of the passage and the external surface of the tube. Air is received by the passage 128 from air passage 104 or 106, as the case may be, with the air flowing through the narrow annulus at very high flow velocities.

A plurality of orifices 130 may extend from the internal passage 126 through the wall of the tube 124 at points which are adjacent to a blind outer end of the tube. Additionally, the orifices 130 are positioned closely adjacent to the surface 54 as described in regard to FIG. 2. The orifices 130 are positioned inboard from the surface 54 such that fuel is discharged through the orifices into the air stream in the narrow annulus between the surface of passage 128 and the exterior surface of tube 124 at a point immediately adjacent to the point where the air stream rapidly expands on reaching the surface 54.

The position of the orifices 130 with respect to the surface 54 is critical to the functioning of the combustion flame injectors 48.

It has been found that an annular width of 0.005 to 0.010 inches works well in the injectors of the invention. Desirably, liquid fuel injected into the annulus does not pass through the annulus to contact the wall of the passage 128 but is broken up in the annulus. If the fuel does contact the wall of passage 128, the fuel may coalesce on the wall and then be torn from the wall in the form of sheets of fuel by the force of the air stream. When this occurs, the fuel may form larger droplets within the air stream. Desirably, fuel which is injected into the annular air stream never sees another surface and is broken up entirely within the air stream.

If the orifices 130 were positioned outboard of the surface 54, the fuel injected through the orifices could pass entirely through the air stream and, thus, not break up into finely divided droplets. It is, therefore, necessary that the orifices 130 be positioned inboard of the surface 54 to insure that the injected fuel remains in the air stream. However, if the orifices 130 are located too far inboard from the surface 54, there is an increased likelihood that the injected fuel will contact one or more surfaces with the fuel then being torn from the surface and possibly deposited on a new surface, etc. to form larger fuel droplets.

To assist the breakup of the fuel within the injectors 48, it is desirable that the orifices be sized for the nominal operating conditions to reduce the force of the injected fuel to a level where it is unlikely that the fuel will reach the surface of the passage 128. Also, it is necessary there be some pressure drop as the fuel passes through the orifices 130 to insure that the fuel passes through all the orifices (such as 4) to be uniformly distributed about the annulus. The orifices 130 may have, for example, a diameter of about 0.021 inches with a blind tube 124 having an O.D. of about 0.125 inches and a passage 128 having an I.D. of about 0.135 inches. Also, the orifices 130 may be located a distance inboard from the surface 54 which is equal to about twice the diameter of the orifices.

Turning to the pilot flame injector 46, this injector includes a seating member 132 which defines an opening 134 that may receive fuel from the fuel line 98. The seating member 132 engages threads 138 and bears against an O-ring 140 to form a tight seal. Fuel which is received within the opening 134 may be conveyed through a constriction 136 to a tube 142. The tube 142 may be surrounded by a support member 146 having a bore 148 therein through which the tube 142 passes. To maintain the outer surface of the tube 142 uniformly spaced from the bore 148, a wire 150 may be positioned about the tube with the wire acting as a spacer element and maintaining a uniform distance between the tube and bore.

A flange 152 may be formed on support member 146 to assist in the support of the soot protector 50, as described with regard to FIGS. 2 and 4. Additionally, the exterior surface of the support member 146 may be threaded at 154 to accomodate the nut 56 described in regard to FIGS. 2 and 4 which may coact with the flange 152 to provide support for the soot protector 50.

A sleeve insert 156 may be positioned within the bore 148 at its outboard end with the inner dimension of the sleeve being only slightly greater than the exterior dimension of the tube 142 to form a narrow annulus therewith. Air passing through this annulus which is received from the air passage 108 may attain very high speeds. A plurality of apertures 158 may be formed in the wall of the tube 142 adjacent the blind end of the tube with the apertures being positioned closely adjacent to the outboard end of the sleeve 156. Fuel which passes through the apertures 158 is, thus, broken up into finely divided droplets by the extreme forces generated by air passing through the annulus.

As described with regard to the combustion flame injectors 48, the positioning of the apertures 158 with respect to the outboard end of the sleeve 156 is critical.

The same considerations apply in the positioning of the apertures 158 with respect to the outboard end of sleeve 156 as applied to the positioning of orifices 130 relative to surface 54 in the injector 48. Thus, the apertures 158 cannot be positioned outboard of the sleeve 156 and also cannot be positioned too far inboard of the outboard end of sleeve 156 without contributing to the formation of large fuel droplets. Desirably, the size of the apertures 158 is comparable to the size of orifices 130 and the distance across the annulus between tube 142 and sleeve 156 is comparable to the annulus between tube 124 and passage 128. Also, a suitable distance between the apertures 158 and the outboard end of sleeve 156 may be in the order of about two times the aperture diameter.

As described in the foregoing description, the combustion flame injectors 48 are preferably positioned at an angle with respect to the pilot flame injector 46. However, it is not essential that the combustion flame injectors 48 be positioned at an angle so long as the discharged combustion fuel enters the flow of combustion air 20 and does not unduly impinge on the inlet opening 26 or the wall 8 to create soot deposits thereon or enter the stagnant air region 32 to an extent that creates objectionable smoking of the burner (see FIGS. 1 and 4). In practice it has been found that a desirable ratio of the internal diameter of the inlet opening 26 to the internal diameter of the burner body 6 is in the order of about 0.4 to 1.0. Also, a desirable ratio of the outer diameter of the mixing chamber 10 with respect to the inner diameter of the inlet opening 26 is in the order of about 1.7 to 1.0. However, the geometry of the burner 2 may be varied in accord with the invention so long as the flow of combustion air 20 establishes the relatively stable stagnant air region 32 within which the pilot flame 33 is maintained as illustrated in FIGS. 1 and 4.

It is claimed:

1. A fuel burner comprising means forming a burner chamber of cylindrical shape and defining a burner axis therein, said chamber having an inlet opening at one end and including a peripheral cylindrical wall extending from one end to the other and displaced from said axis by a predetermined radial dimension, means forming a vortex box disposed in coupled relation to said inlet opening for introducing combustion air into said body and along said axis, said vortex box having a plurality of internal vanes arranged in a circle surrounding said axis and radially tilted thereto for imparting spiral flow to air passing through and along the axis of said burner, port means coupling said vortex box to said chamber and having a radial dimension from the axis which is less than the radial dimension of said burner wall, said coupling means and burner wall being constructed and arranged to form an expansion step for combustion air flowing therebetween so that a flow pattern through the burner is established in which combustion air is introduced through said inlet in an axial direction to produce a swirling air flow about said axis and along a generally cylindrically annular combustion zone, the combustion air moving forwardly and outwardly as it passes past the step and through said zone, a portion thereof recirculating by moving in a rearward direction along the axis of the burner and towards the inlet opening and vortex box to produce a secondary flow in opposition to the general flow of combustion air therethrough to thereby establish a stagnant air region at the inlet to said burner which region remains relatively constant with respect to the overall flow rate of combustion air therethrough, pilot injector means for injecting a limited quantity of liquid fuel into said stagnant region and directed along the axis of said chamber, said fuel being ignited therein to form a stable pilot flame for said burner, main fuel injector means for injecting finely divided liquid fuel generally along said burner axis and into the region of said combustion zone, said injector means being constructed and arranged to limit the injected liquid to a region bounded by a cylindrical surface surrounding said stagnant zone and extending radially therefrom to said main fuel injector means.

2. The burner of claim 1 wherein the means to inject finely divided fuel into the combustion air includes:

a plurality of combustion flame injectors positioned around said pilot flame injector;

means to supply finely divided fuel through said combustion flame injectors, and said combustion flame injectors positioned to discharge finely divided fuel into said combustion air, for combustion therewith with minimal or no contact of said fuel with said inlet opening and with minimal or no discharge of said fuel into said stagnant air region.

3. The burner of claim 2 including:

a soot protector positioned about said pilot flame injector;

said soot protector extending toward said combustion flame injectors, and said soot protector being heatable to a sufficient extent by the surrounding environment to prevent the formation of soot thereon through contact of unburned fuel with said soot protector.

4. The burner of claim 2 including a curved surface forming said inlet opening;

said surface opening outwardly in a downstream direction, and said surface being positioned axially with respect to said burner body, whereby combustion air entering said burner undergoes forward flow on moving along said curved surface.

5. The burner of claim 3 including:

a curved surface forming said inlet opening;

said surface opening outwardly in a downstream direction, and said surface being positioned axially with respect to said burner body, whereby combustion air entering said burner undergoes forward flow on moving along said curved surface.

6. The burner of claim 4 wherein:

said burner body has an internal diameter and said inlet opening has an internal diameter, and the ratio of the internal diameter of the inlet opening to the internal diameter of the burner body is in the order of about 0.4 to 1.0.

7. The burner of claim 4 including:

a mixing chamber communicating with said burner body through said inlet opening;

said mixing chamber having an outer diameter and a back surface;

a plurality of vanes positioned about the outer diameter of said mixing chamber to receive air and to direct the air in a swirling motion into said mixing chamber, and said pilot flame injector and said combustion flame injectors extending through said back surface.

8. The burner of claim 7 wherein:

the ratio of the outer diameter of said mixing chamber to the inner diameter of said inlet opening is in the order of about 1.7 to 1.0.

9. The burner of claim 1 including:

means to intermix cool air with combustion gases formed within said burner, and said means to intermix cool air being positioned downstream from said inlet opening a sufficient distance to permit the essential completion of combustion within said burner before intermixing of the cool air with the combustion gases.

10. The burner of claim 9 wherein the means to intermix cool air includes:

a plurality of holes extending through said burner body, and said holes having openings of varying sizes to promote thorough mixing of combustion gases within the burner body with cool air entering the burner body through said holes.

11. A fuel burner as in claim 1 in which said main fuel injector means comprises:

means providing an annular passage through which air may flow at high velocities for discharge into a burner;

means to feed fuel into said passage such that the fuel may be broken up into minute droplets by air flow through the passage, and said means to feed fuel being positioned to minimize contact of fuel with the passage surfaces, whereby the fuel may be broken up into minute droplets within the air flow stream and then discharged in finely divided form into said burner.

12. A fuel burner as in claim 1 in which said main fuel injector means comprises:

a first passage having an internal diameter;

a tube having an external diameter positioned within said passage;

an annular opening formed between the internal diameter of said first passage and the external diameter of said tube for transmitting air at high velocities;

a second passage within said tube;

an orifice passing from said second passage into said annular opening to feed fuel into said opening, and said first passage terminating at a point positioned at a distance outboard of said orifice which is sufficiently small to minimize contact between fuel injected through said orifice and said first passage, whereby fuel injected into said annular opening through said orifice may be broken up into finely divided particles within a high velocity air stream passing through the annular opening with minimal contact between injected fuel and the first passage and tube surfaces forming the annular opening prior to discharge of the mixed fuel and air from the annular opening.

13. The injector of claim 12 wherein:

said orifice has a diameter, and the distance between said orifice and said point of termination is in the order of about twice said orifice diameter.

14. The injector of claim 12 wherein:

the distance across said annular opening is about 0.005 to about 0.010 inches.

15. The injector of claim 13 wherein:

the distance across said annular opening is about 0.005 to about 0.010 inches.

16. A fuel burner comprising means forming a burning chamber of cylindrical shape and defining a burner axis therein, said chamber having an inlet opening at one end and including a peripheral cylindrical wall extending from one end to the other and displaced from said axis by a predetermined radial dimension means forming a vortex box disposed in coupled relation to said inlet opening for introducing combustion air into said body and along said axis, having a back wall spaced away from said inlet opening and having a plurality of internal vanes arranged in a circle surrounding said axis and radially tilted thereto for imparting spiral flow to air passing through and along the axis of said burner, port means coupling said vortex box to said chamber and having a radial dimension from the axis which is less than the radial dimension of said burner wall, said coupling means and burner wall being constructed and arranged to form an expansion step for combustion air flowing therebetween, so that a flow pattern through the burner is established in which combustion air is introduced through said inlet in an axial direction to produce a swirling air flow about said axis and along a generally cylindrical annular combustion zone, the combustion air moving forwardly and outwardly as it passes past the step and through said zone, a portion thereof recirculating by moving in a rearward direction along the axis of the burner and towards the inlet opening and vortex box to produce a secondary flow in opposition to the general flow of combustion air therethrough to thereby establish a stagnant air region at the inlet to said burner which region remains relatively constant with respect to the overall flow rate of combustion air therethrough, pilot injector means comprising a nozzle mounted to discharge fuel immediately adjacent to said back wall for injecting a limited quantity of liquid fuel into said stagnant region and directed along the axis of said chamber, said fuel being ignited therein to form a stable pilot flame for said burner, main fuel injector means for injecting finely divided liquid fuel generally along said burner axis and into the region of said combustion zone, a plurality of nozzles disposed along an annular ring surrounding said pilot injector means and having outlet orifices located substantially proximate to said back wall, said injector means being constructed and arranged to limit the injection to a region bounded by a cylindrical surface surrounding said stagnant zone and extending radially therefrom to said main fuel injector means and a conical surface intersecting the main fuel injector means and passing adjacent said port means.

* * * * *